United States Patent [19]

Ruid et al.

[11] Patent Number: 4,629,473

[45] Date of Patent: Dec. 16, 1986

[54] RESILIENT ABRASIVE POLISHING PRODUCT

[75] Inventors: John O. Ruid, Clifton Park; Edgar A. Stein, North Greenbush, both of N.Y.

[73] Assignee: Norton Company, Worcester, Mass.

[21] Appl. No.: 749,068

[22] Filed: Jun. 26, 1985

[51] Int. Cl.[4] ..... B24D 11/02

[52] U.S. Cl. ..... 51/295; 51/298

[58] Field of Search ..... 51/295, 298

[56] References Cited

U.S. PATENT DOCUMENTS

| | | | |
|---|---|---|---|
| 3,607,159 | 9/1971 | Haywood | 51/295 |
| 3,653,859 | 4/1972 | Zimmer, Jr. et al. | 51/295 |
| 4,018,574 | 4/1977 | Dyer | 51/295 |
| 4,035,961 | 7/1977 | Pemrick et al. | 51/295 |
| 4,038,047 | 7/1977 | Haywood | 51/295 |
| 4,082,521 | 4/1978 | McGarvey | 51/295 |
| 4,162,899 | 7/1979 | Molnar et al. | 51/295 |
| 4,163,647 | 8/1979 | Swiater | 51/295 |
| 4,317,660 | 3/1982 | Kramis et al. | 51/295 |
| 4,504,283 | 3/1985 | Charvat | 51/298 |

*Primary Examiner*—Prince E. Willis
*Assistant Examiner*—Willie J. Thompson
*Attorney, Agent, or Firm*—Frank S. Chow; Norvell E. Wisdom

[57] ABSTRACT

A coated abrasive surface polishing product with excellent finish refinement capability and long life can be made by coating a layer of resilient material laminated to a conventional coated abrasive backing with an elastomeric maker adhesive and conventional abrasive grain. Optionally, an intermediate elastomeric adhesive layer may be used between the resilient layer and the maker. The best resilient layer is a reticulated open cell foam with a 50% compression force of less than 90 kilopascals, and the best elastomers, for both maker and any intermediate coating used, have after cure a tensile strength between 30 and 52 megapascals, a 100% modulus between 2.4 and 16 megapascals, and an ultimate elongation to break between 375% and 750%. For long useful life, the product preferably should have a phenolic resin sizing adhesive over the abrasive grain.

14 Claims, No Drawings

RESILIENT ABRASIVE POLISHING PRODUCT

BACKGROUND OF THE INVENTION

1. Field of the Invention

This invention relates to the field of articles of manufacture suitable for polishing or otherwise improving the uniformity of finish of surfaces of solid objects, particularly those of made of hard materials such as most metals and glass. More particularly, this invention relates to such articles of manufacture comprising size graded abrasive grain fixed to and supported by a resilient backing material, which is itself fixed to and supported by a primary backing material. The primary backing is suitable for joining into belts or cutting into discs, sheets, etc. useful in mechanical or manual operations of the type in which conventional coated abrasives, buffs, or other similar conventional surface finishing tools might also be employed.

2. Technical Background

U.S. Pat. No. 3,607,159 to Haywood describes a resilient, controlled density, porous structure laminated to flexible backing. The structure contains fine abrasive particles adhesively bonded to the surface opposite the backing and distributed within the resilient structure, with the abrasive density varying inversely to the distance from the backing. A protective abrasion-resistant layer is interposed between the abrasive grain and the surfaces of the resilient structure. The resilient, controlled density, porous structure has a resiliency characterized by a 25% compression force in the range from 10–50 pounds per square inch, a density of from 10–30 pounds per cubic foot, and a porosity of from 55–85 percent.

U.S. Pat. No. 3,653,859 to Zimmer et al. describes a high density abrasive-containing foam product which is made by impregnating a low density foam with a slurry of adhesive and abrasive, drying the same below the cure temperature of the adhesive, and then laminating the dried and impregnated foam to a reinforcing backing by heat and pressure, which both densify the foam and effect the lamination, using the abrasive binder adhesive to obtain adhesion between the foam component and the backing component. The initial foam has a 25% compression force value in the range of 10–30 pounds per square inch, and the foam is usually compressed to one quarter or less of its original thickness during the process of making the product.

U.S. Pat. No. 4,038,047 to Haywood describes a complex process of making a suitable resilient backing for an abrasive polishing product. In this process, small particles of resilient foam are packed into a cylinder and densified by an adhesive binder; a thin continuous sheet is peeled from the outer surface of the resulting coherent cylinder of bonded foam; and the resulting sheet is sanded by abrasives to prepare its surface for coating with abrasive grain and binder therefor.

U.S. Pat. No. 4,504,283 to Charvat describes another type of resilient abrasive especially suited to sharpening edged cutting tools. This product utilizes only grit 700 or finer abrasives, and visual discontinuities, such as clusters of cells or voids, on the abrasive surface are stated to be undesirable.

SUMMARY OF THE INVENTION

We have found that a polishing product with excellent performance can be made conveniently by laminating to a suitable primary backing a foam or other resilient material which is more easily compressed than the resilient materials used in the art described above, coating the resilient side of the laminate with an elastomeric maker adhesive, electrostatically coating abrasive grain into the still wet elastomeric maker adhesive, and drying and/or curing the maker adhesive. Optionally, one or more intermediate elastomeric adhesives is used between the resilient backing layer and the maker adhesive, and preferably, a sizing adhesive is applied over the abrasive grain. The final product has a 25% compression force value, i.e., the force required to compress the entire product to 75% of the thickness it has when uncompressed, between one hundred thirty-five and fourteen hundred kilopascals.

DESCRIPTION OF THE PREFERRED EMBODIMENTS

The primary backing may be any material suitable for conventional coated abrasives. Suitably finished cloth is generally preferred because of its adaptability to be joined into belts adapted for use on a wide variety of machinery, but in appropriate circumstances paper, vulcanized fiber, non-woven webs, or plastic film such as that made from poly(ethylene terephthalate) or poly(vinyl chloride) could also be used. In many cases, polishing of surfaces is facilitated by keeping them wet, and for such applications, the backing should be waterproof.

Finished cloth backings preferred for most of the products described herein were made using a stitch bonded fabric of the general type described in U.S. patent application Ser. No. 06/664,446 by Darjee, filed October 23, 1984 and hereby incorporated herein by reference. A particular fabric of the type described by Darjee which was used for many of the examples of this invention specified below had warp yarns of 1300 denier high tenacity poly(ethylene terephthalate) multifilament at a gauge of 14 yarns per 25 mm, fill yarns of 150 denier texturized poly(ethylene terephthalate) at a count of 128 yarns per 25 mm, and stitch yarns of 70 denier high tenacity multifilament poly(ethylene terephthalate). This fabric was saturated with a mixture of an aqueous dispersion of an epoxy resin and 2-methyl imidazole, which functions as a curing agent, as described in detail in U.S. Pat. No. 4,396,657 hereby incorporated herein by reference. The add-on weight of saturant was about 65 gm/m$^2$. The saturated cloth was then backfilled and frontfilled with a calcium carbonate filled resole phenolic resin having a molar formaldehyde:phenol ration of about 1.5. Dry add-on weights were about 100 gm/m$^2$ for the frontfill and 245 gm/m$^2$ for the backfill. The backing thus finished is designated in the Examples below as Backing P1.

A second backing based on fabric of the Darjee type utilized in some of the Examples below, under the designation P2, had warp yarns of 440 denier high tenacity multifilament poly(ethylene terephthalate), with other fabric construction the same as described for Backing P1. The saturant for Backing P2 was a mixture of 100 parts of a self-cross linking acrylic latex (K-87 from Rohm & Haas), 1 part of an acrylic latex thickening agent (ASE-60 from Rohm & Haas), 1 part diammonium hydrogen phosphate, and 6 parts water. (Here and elsewhere in this specification unless specifically otherwise stated, parts are to be interpreted as parts by mass or weight.) This adhesive mixture was applied to the cloth by a two vertical roll padder in an amount sufficient to give a add-on weight of 45 g/m$^2$ after the saturated cloth was dried in a tenter.

Another backing used for the Examples was a finished rayon drills woven cloth backfilled with an acrylic latex and frontfilled (on the twill side) with a mixture of acrylic latex and phenolic resin. This is denoted herein as "Backing R".

The resilient material preferably has a 50% compression force value, i.e., the force required to compress the material to half of its resting thickness, of from 3.5 to 65 kilopascals (kPa), with values from 7 to 33 kPa more preferred. Spun-bonded non-woven webs, air-laid fiber webs, and similar materials are suitable for the resilient backing layer, but self cohesive open-celled foams are preferred, with reticulated foams more preferred. The diameter of the cells of the foam preferably is from 2–10 times the diameter of the average grain to be coated thereon, with a range of 4–7 times the grain diameter most preferred. Examples of commercial foams particularly suitable for most products according to this invention are Scottfelt 3-900-Q and 3-900-Z, both available from The Scottfoam, Eddystone, Pa. and Rogers REJ-8710, available from Rogers Foam Co., Sommerville, Massachusetts. Some physical properties of these foams are given in Table 1. It may be noted that these foams all have much smaller force requirements for compression than the foams specified for the products of the prior art Haywood and Zimmer patents noted above.

The resilient backing may be laminated to the primary backing by any convenient conventional technique, and the choice of laminating adhesive also may be made according the general knowledge of the art, giving due consideration to the environmental resistance requirements for the final product and the chemical nature of the resilient and primary backings. Preferably the laminating adhesive should have a bond peel strength of at least 4 pounds per inch as measured by ASTM D-1876 T-Peel Test, or at least sufficient peel strength to exceed the cohesive strength of the resilient backing layer.

TABLE 1

PHYSICAL PROPERTIES OF SELECTED FOAMS

| Foam Identification | Thickness, Millimeters | Tensile Strength, Newtons Per Cm Of Width | Percent Elongation at Break | 50% Compression Force, Kilopascals |
|---|---|---|---|---|
| 3-900-Q | 1.44 | 6.07 | 340 | 13.1 |
| 3-900-C | 1.52 | 8.04 | 340 | 16.6 |
| REJ 8710 | 2.41 | — | — | 10.3 |

Note:
All properties measured on dry foams.

TABLE 2

PHYSICAL PROPERTIES OF SELECTED ELASTOMERIC ADHESIVES

| Adhesive Identification | Tensile Strength, Megapascals | Percent Elongation to Break | Force Required to Stretch to Twice Original Length, Megapascals |
|---|---|---|---|
| W-160 | 29.7 | 725 | 2.4 |
| 6545 | 46.9 | 630 | 6.9 |
| B670 | 51.7 | 380 | 15.9 |

Note:
Additional description of the adhesives is given in the specification.

Two different laminating techniques and adhesives were used in the specific Examples described below. In Method A, the adhesive composition was 100 parts K-87, 2 parts ASE-60, 1 part diammonium phosphate, and 9 parts water. The adhesive was knife coated onto the primary backing. The resilient backing was then pressed into the wet adhesive on the primary backing by compression rolls, resulting in a preliminary bond which was fully developed by drying the laminate. In Method B, the adhesive composition was a polyurethane latex, Witcobond 160 available from Witco Chemical Co., Houston, Tex. In this method, the resilient backing was dipped into the adhesive, thus partially saturating it, and the wet saturated resilient backing was pressed against the dry primary backing between nip rolls to develop a primary bond which again was fully developed by drying the laminate. The amounts of laminating adhesive are specified in the Examples.

After being laminated to the primary backing, the resilient backing layer is coated on its open side with a first elastomeric adhesive coating. This first coating may be either the maker adhesive or an intermediate layer between the resilient backing and the maker adhesive as already noted. The adhesive used for the first coating, after cure, should be less compressible than the resilient backing layer but considerably more resilient than the phenolic resin adhesives most often used to make conventional coated abrasives. Preferably, the material for the first elastomeric coating should cure to give a product with tensile strength between 14 and 70 megapascals (MPa), a tensile force to stretch to twice its resting length (i.e., 100% modulus) of from 1.4 to 21 MPa, and an ultimate elongation to break of from 125–1000% of original resting length. More preferably, the tensile strength should be from 30 to 52 MPa, the 100% modulus should be from 2.4 to 16 MPa, and the ultimate elongation to break should be from 375–750%. Such properties are available from a wide variety of synthetic and natural elastomers as generally known in the art, but polyurethanes are preferred for their combination of attractive properties.

The first elastomeric coating adhesive in the liquid form as coated should not have too great a film strength or viscosity, because it is important for it to penetrate into the interstices of the resilient backing layer before drying and cure. The amount of the elastomeric material used should be sufficient to increase the 50% compression force value of the resilent backing layer by a factor of at least two compared with the uncoated resilient layer. Normally, this will require about 75 to 375 g/m$^2$ of the elastomeric material, and often one coating will be sufficient. However, if the initial resilient layer has a 50% compression force value of less than 10 kPa, the first elastomeric adhesive coating should be sufficient to increase the compression force by a factor of at least ten, and for such products, at least one intermediate elastomeric adhesive coating prior to the maker adhesive will often be required. When two or more separate elastomeric coatings (including the maker adhesive) are used, each successive coating adhesive should preferably be no more easily compressible than the previous such coating, but still within the ranges given above. After completion of any intermediate elastomeric coating(s) before the maker adhesive, the openings in the resilient backing layer should remain at least twice the size of the grain to be coated in the next step.

After all desired intermediate elastomeric adhesive coatings have been applied and appropriately dried and/or cured to a sufficient extent to develop the final mechanical properties of the coating adhesives, an elastomeric maker adhesive is applied. The maker adhesive may be, but need not be, the same chemical composition as an intermediate elastomeric coating. The general mechanical properties of the maker adhesive after cure should be within the same ranges as given above for any intermediate elastomeric coating, but in addition the maker adhesive must have the property of retaining its adhesiveness and sufficiently low viscosity for a sufficient time after coating to permit effective electrostatic coating of abrasive grain into the wet adhesive. Electrostatic coating is accomplished by means conventional and well known in the art of manufacturing conventional coated abrasives. In general, the properties, including size grading standards, of suitable and preferred abrasive grain are correlated with the nature of the workpieces to be polished or otherwise finished and the type of finish desired on these workpieces in the same manner as for conventional coated abrasives, except that the finishes achieved with grain of a given size grade in a product according to this invention are much finer than those achieved from the same grain in a conventional coated abrasive with a comparatively nonresilient backing.

After coating with the maker adhesive and the abrasive grain, the maker adhesive is then dried and/or cured as appropriate to cause it to attain its final mechanical properties. As a result of these processes, the product formed is coated on the side opposite the primary backing with a reasonably uniform layer of abrasive and elastomer, and this layer extends into the openings in whatever type of resilient layer is used. The amount of grain per unit surface area (or areal density) of the outer elastomeric layer is substantially uniform from the outer surface of the product to the bottom of the outer openings in the resilient layer. We consider the layer to be substantially uniform if the areal density of grain at the bottom of the outer openings of the coated resilient backing is not less than half that of the grain on the outer surface of the coated product. The total amount of abrasive grain per nominal surface area, i.e., surface area not considering the additional area provided by the sides of the openings in the resilient backing layer, is normally from 1.2 to 5 times the amount commonly used for closed coat conventional coated abrasive products on nonresilient backings with the same grit size abrasive grain.

While the product may be used effectively in some applications after maker adhesive cure, it is normally preferable to add a final sizing adhesive layer over the grain, as with conventional coated abrasives. The amount and nature of this layer may vary widely, but it need not be elastomeric as required for the coating materials previously used. In fact, a conventional phenolic resin is often preferred as the sizing adhesive, especially when an aggressive product which is still capable of giving a good surface finish is desired. Such a preferred material may be, for example, a sodium hydroxide catalyzed phenol-formaldehyde resole resin with a mole ratio of formaldehyde to phenol of about 1.5. A phenolic resin of this type is designated as Sizing Adhesive "P" in the examples below. The viscosity, coating conditions, amounts, and curing conditions for the sizing adhesive are similar to those conventional for the adhesive used when sizing conventional coated abrasives.

The scope of the invention may be further appreciated from the following non-limiting examples.

EXAMPLES 1–9

These examples illustrate a variety of the generally preferred embodiments of the invention. All of them used some type of reticulated foam as the resilient backing and conventional black silicon carbide abrasive grain graded according to the standards of the (United States) Coated Abrasive Manufacturers' Institute. The elastomeric adhesives used in these examples were Witcobond W-160, already described above; Helastic WX-6545, an aqueous dispersion of a fully reacted aliphatic polyurethane available from Wilmington Chemical Co., Wilmington, Delaware; and Vibrathane B670, a polyether-based prepolymer terminated with 4,4'-diphenyl di-isocyanate, available from Uniroyal Chemical, Naugatuck, Conn. The B670 was mixed with 11.4% of its own weight of 1,4-butanediol before use in the products herein. Some important physical properties of these elastomeric adhesives are shown in Table 2. The variations in the composition of the products of these Examples are shown in Table 3.

Results of comparative performance tests among the products of Examples 1–9 and some commercial products of the prior art are shown in Table 4. The particular results in Table 4 were obtained from a laboratory test procedure using a rotated ring of metal as workpiece. The workpiece was first roughened to a pre-determined surface finish level with a relatively coarse grit abrasive belt, then subjected to finishing by the products of this invention and the comparison products shown in the Table. The arithmetic average finish obtained on the workpiece was measured at appropriate intervals by a Surtronic 3 instrument available from Rank-Taylor-Hobson, Leicester, England. A variety of similar instruments are available. All measure the average scratch depth on the surface, so that low numbers correspond to more reflective, and thus generally more desirable, surface finishes. The amount of metal removed from the workpiece surface was determined by conventional weighing, and the life of the belts was determined by their inability to continue to refine the surface finish in a reasonable time, varying with the original surface finish but consistently applied to all the belts within one group in Table 4.

TABLE 3

COMPOSITION DETAILS OF PRODUCTS FROM EXAMPLES 1–9

| Example No. | Foam Type | Laminating Adhesive Type | Laminating Adhesive Gms/M² | Intermediate Adhesive Type | Intermediate Adhesive Gms/M² 1st Coat | Intermediate Adhesive Gms/M² 2nd Coat | Maker Adhesive Type | Maker Adhesive Gms/M² | Abrasive Grain Grit | Abrasive Grain Gms/M² | Sizing Adhesive Type | Sizing Adhesive Gms/M² |
|---|---|---|---|---|---|---|---|---|---|---|---|---|
| 1 | 8710 | A | 60 | none | | | B670 | 592 | 240 | 130 | P | 20–40 |
| 2 | 900Q | A | 130 | none | | | B670 | 385 | 400 | 89 | U | 118 |
| 3 | 8710 | A | — | W160 | 50 | none | B670 | 636 | 240 | 117 | P | 20–40 |
| 4 | 8710 | B | 104[a] | [none, except cf.[a]] | | | B670 | 533 | 240 | 143 | P | 20–40 |
| 5 | 8710 | B | 118[a] | [none, except cf.[a]] | | | B670 | 340 | 400 | 145 | P | 20–40 |

TABLE 3-continued

COMPOSITION DETAILS OF PRODUCTS FROM EXAMPLES 1-9

| Example No. | Foam Type | Laminating Adhesive Type | Laminating Adhesive Gms/M² | Intermediate Adhesive Type | Intermediate Adhesive Gms/M² 1st Coat | Intermediate Adhesive Gms/M² 2nd Coat | Maker Adhesive Type | Maker Adhesive Gms/M² | Abrasive Grain Grit | Abrasive Grain Gms/M² | Sizing Adhesive Type | Sizing Adhesive Gms/M² |
|---|---|---|---|---|---|---|---|---|---|---|---|---|
| 6 | 8710 | B | 340[a] | W160 | 104[b] | 89 | 6545 | 178 | 240 | 118 | P | 20–40 |
| 7 | 8710 | B | 118[a] | W160 | 104[b] | 89 | 6545 | 178 | 400 | 104 | P | 20–40 |
| 8 | 8710 | B | 104[a] | 6545 | 192[b] | none | 6545 | 178 | 240 | 118 | P | 20–40 |
| 9 | 8710 | B | 104[a] | 6545 | 192[b] | none | 6545 | 178 | 400 | 104 | P | 20–40 |

Note:
The primary backing was P2 for Examples 1 and 2, P1 for Examples 3, 5, 7, 8, and 9, and R for Examples 4 and 6. The properties of the adhesives and abrasive grain are described in detail in the specification.
[a]The laminating adhesive was applied to both sides of the foam, so that approximately half of it acted as an intermediate elastomeric adhesive coating.
[b]This amount was applied in addition to the amount derived from the laminating adhesive as described in footnote a.

TABLE 4

COMPARISON OF TEST RESULTS OBTAINED WITH PRODUCTS OF THIS INVENTION AND PRODUCTS FROM THE PRIOR ART

| Coated Abrasive Type | Grit Size | Workpiece Material | Test Results: For First Ten Minutes: Surface Finish, Microns | Test Results: For First Ten Minutes: Grams Cut from Work-Piece | Test Results: Total Life of Belt in Minutes |
|---|---|---|---|---|---|
| W449 | 240 | Aluminum | 1.02 | 25.6 | — |
| 1 | 240 | Aluminum | 0.58 | 24.8 | — |
| W449 | 400 | Aluminum | 0.74 | 16.5 | — |
| 2 | 400 | Aluminum | 0.33 | 3.9 | — |
| W421 | 150 | Ty 304 SS | 2.41 | 30.8 | 14 |
| 3 | 240 | Ty 304 SS | 0.91 | 11.0 | 54 |
| 4 | 240 | Ty 304 SS | 0.23 | 16.6 | 20 |
| 6 | 240 | Ty 304 SS | 0.30 | 13.9 | 70 |
| 8 | 240 | Ty 304 SS | 0.30 | 14.7 | 75 |
| W421 | 800 | Ty 304 SS | 0.84 | 8.7 | 14 |
| 5 | 400 | Ty 304 SS | 0.15 | 0.5 | 18 |
| 7 | 400 | Ty 304 SS | 0.18 | 1.0 | 30 |
| 9 | 400 | Ty 304 SS | 0.15 | 0.5 | 78 |

Notes for Table 4
W449 is a conventional waterproof closed coat silicon carbide coated abrasive cloth, and W421 is a silicon carbide coated cork polishing cloth which is a common conventional choice of the prior art for achieving a lustrous surface finish with coated abrasive products. Both are available from Norton Co., Worcester, Massachusetts.
Numbers under the column "Coated Abrasive Type" refer to products from the corresponding Example number of this specification.
"Ty 304 SS" means Type 304 stainless steel. Test procedures are described in the specification.

It is clear from the the first two groups in the Table that the products of this invention are highly superior to conventional coated abrasive products for refining surface finish on aluminum. In grit 240, the amount of aluminum removed is only slightly less than with a conventional product, but the scratch depth is only about half as much at the end. In grit 400, an even larger improvement in surface finish is achieved with the removal of only about one quarter as much metal.

On stainless steel, as shown in the two larger groups in Table 4, the finishing advantages of the products of our invention are equally pronounced, and some embodiments of our invention also achieve very significant increases in product life. These results also show how the choices of components within the scope of our invention may be varied to give product characteristics which are advantageous in various circumstances. Thus, products from Examples 4 and 5, which have relatively little intermediate elastomeric adhesive coating, can achieve at least slightly finer finishes but last for a much shorter time than the others, all of which have more intermediate coating. For grit 240, the product of Example 8, with only a single intermediate coating, achieves slightly longer life but removes slightly more material than the product of Example 6, with two intermediate coatings. The results are close enough, however, to make both products essentially equally effective. In grit 400 on the other hand, the composition with only one intermediate elastomeric coating has finer finish, less metal removal, and longer product life.

Achieving a desired surface level without removing much of the material finished is normally advantageous for a surface finishing product, which often is used on plated, coated, laminated, or other workpieces with relatively thin decorative surface layers. For some workpieces, however, which start with a significant fraction of exceptionally deep scratches, removing substantial amounts of stock may be necessary to achieve the desired degree of surface finish, so that a more aggressive product is needed in such cases. To some extent, these properties can be adjusted within the scope of our invention, as shown above.

Practical Testing

In addition to the laboratory testing described above, products made according to some of the examples were tested under conditions similar to those expected to prevail in actual use of the products. Some of the results of these tests are given here to illustrate the utility of the products according to this invention.

Product from Example 9 was tested in the form of belts on a conventional flat polishing coated abrasive belt machine with water flood during polishing. The workpieces were lighting fixtures made from an acrylic plastic. The coated abrasive product previously used by the commercial manufacturer of these lighting fixtures was a grit P400 waterproof aluminum oxide product, coated on a conventional non-resilient backing, from an established commercial manufacturer of coated abrasives. This conventional product lasted six hours in normal use and finished 600 fixtures. The product according to this invention lasted 30 hours and finished three thousand fixtures. The product according to this invention also reduced by 30% compared with the conventional prior art product the time required in subsequent buffing of the finished fixtures.

Product made according to Example 8 was tested in polishing small diameter zirconium alloy tubing used for holding nuclear fuel in nuclear reactors. A conventional centerless coated abrasive polishing machine was used, and the product of this invention was compared with prior art commercial product W421 already described above. The product according to this invention lasted at least twice as long in this application.

Products made according to both Examples 5 and 8 was tested in finishing brass film platens for hospital X-ray cameras. The prior art product for this application was a lofty abrasive wheel. The results with the products of this invention were judged substantially superior, especially because of the fineness of the finishes achieved, by the user, a well known manufacturer of cameras.

Product made according to Example 9 was tested for the centerless polishing of tubing made of fiberglass and vulcanized fiber. The conventional prior art product for this application was a cork coated abrasive made by a leading manufacturer of coated abrasives. The product according to the present invention finished more than 50% more tubes than the prior art product.

We claim:

1. A coated abrasive product having a 25% compression force value between 135 and 1400 kilopascals, comprising:

(a) a primary backing;

(b) a resilient backing layer of reticulated open cell foam, said foam layer having a 50% compression force value between 3 and 62 kilopascals and openings in the surface thereof and being adhered on one major surface to said primary backing; and (c) a layer of size-graded abraisve grain having an average size not greater than one half the average size of the openings in said resilient backing, said abrasive grain being distributed substantially uniformly over the major surface of said resilient backing opposite said primary backing, including the portions of such surface which are recesses from the outer envelope of the surface, and being adhered thereto by an elastomeric maker adhesive.

2. A coated abrasive according to claim 1, further comprising a sizing adhesive layer which is the cured product of a resole phenol-formaldehyde resin and which overlies said layer of abrasive grain.

3. A coated abrasive according to claim 2, wherein said maker adhesive has after cure a tensile strength between 14 and 70 megapascals, a 100% modulus between 1.4 and 21 megapascals, and an ultimate elongation to break between 125% and 1000%.

4. A coated abrasive according to claim 3, wherein said maker adhesive has after cure a tensile strength between 30 and 52 megapascals, a 100% modulus between 2.4 and 16 megapascals, and an ultimate elongation to break between 375% and 750%.

5. A coated abrasive product having a 25% compression force value between 135 and 1400 kilopascals, comprising:

a. a primary backing;

b. a resilient backing having openings in the surface thereof and adhered on one major surface to said primary backing; and c. at least one intermediate elastomeric adhesive layer covering the major surface of said resilient backing opposite said primary backing, including the portions of such surface which are recesses from the outer envelope of the surface; and d. a layer of size-graded abrasive grain having an average size not greater than one half the average size of the openings in said elastomeric adhesive coated resilient backing, said abrasive grain being distributed substantially uniformly over said elastomeric adhesive coated surface of said resilient backing and being adhered thereto by an elastomeric maker adhesive.

6. A coated abrasive according to claim 5, wherein said resilient layer is a reticulated open cell foam having a 50% compression force value between 3 and 62 kilopascals.

7. A coated abrasive according to claim 6, further comprising a sizing adhesive layer which is the cured product of a resole phenol-formaldehyde resin and which overlies said layer of abrasive grain.

8. A coated abrasive according to claim 7, wherein said intermediate elastomeric adhesive and said elastomeric maker adhesive both have after cure a tensile strength between 14 and 70 megapascals, a 100% modulus between 1.4 and 21 megapascals, and an ultimate elongation to break between 125% and 1000%.

9. A coated abrasive according to claim 8, wherein said intermediate elastomeric adhesive and said elastomeric maker adhesive both have after cure a tensile strength between 30 and 52 megapascals, a 100% modulus between 2.4 and 16 megapascals, and an ultimate elongation to break between 375% and 750%.

10. A coated abrasive according to claim 9, further comprising a sizing adhesive layer which is the cured product of a resole phenol-formaldehyde resin and which overlies said layer of abrasive grain.

11. A coated abrasive according to claim 10, wherein said intermediate elastomeric adhesive and said elastomeric maker adhesive both have after cure a tensile strength between 14 and 70 megapascals, a 100% modulus between 1.4 and 21 megapascals, and an ultimate elongation to break between 125% and 1000%.

12. A coated abrasive according to claim 11, wherein said intermediate elastomeric adhesive and said elastomeric maker adhesive both have after cure a tensile strength between 30 and 52 megapascals, a 100% modulus between 2.4 and 16 megapascals, and an ultimate elongation to break between 375% and 750%.

13. A coated abrasive according to claim 5, wherein said intermediate elastomeric adhesive and said elastomeric maker adhesive both have after cure a tensile strength between 14 and 70 megapascals, a 100% modulus between 1.4 and 21 megapascals, and an ultimate elon to break between 125% and 1000%.

14. A coated abrasive according to claim 13, wherein said intermediate elastomeric adhesive and said elastomeric maker adhesive both have after cure a tensile strength between 30 and 52 megapascals, a 100% modulus between 2.4 and 16 megapascals, and an ultimate elongation to break between 375% and 750%.

* * * * *